US005278129A

United States Patent [19]

Watanabe et al.

[11] Patent Number: 5,278,129

[45] Date of Patent: Jan. 11, 1994

[54] REWRITABLE THERMOSENSITIVE RECORDING MEDIUM

[75] Inventors: Niro Watanabe; Atsushi Kijima; Yuji Nakatsu; Susumu Watanabe, all of Tokyo, Japan

[73] Assignee: Toppan Printing Co., Ltd., Tokyo, Japan

[21] Appl. No.: 972,939

[22] Filed: Nov. 6, 1992

[30] Foreign Application Priority Data

| | | | |
|---|---|---|---|
| Nov. 20, 1991 | [JP] | Japan | 3-304690 |
| Jul. 30, 1992 | [JP] | Japan | 4-203955 |
| Jul. 30, 1992 | [JP] | Japan | 4-203956 |

[51] Int. Cl.[5] ..... B41M 5/36

[52] U.S. Cl. ..... 503/217; 503/201; 503/225

[58] Field of Search ..... 503/208, 201, 217, 225; 430/19; 428/195, 913

[56] References Cited

U.S. PATENT DOCUMENTS

| | | | |
|---|---|---|---|
| 4,268,413 | 5/1981 | Dabisch | 252/408 |
| 4,695,528 | 9/1987 | Dabisch et al. | 430/290 |
| 4,917,948 | 4/1990 | Hotta | 428/335 |
| 5,001,106 | 3/1991 | Egashira et al. | 503/227 |
| 5,085,934 | 2/1992 | Hotta et al. | 428/335 |
| 5,087,601 | 2/1992 | Hotta et al. | 503/200 |
| 5,157,011 | 10/1992 | Okabe et al. | 503/201 |
| 5,158,924 | 10/1992 | Konagaya et al. | 503/201 |

FOREIGN PATENT DOCUMENTS

| | | |
|---|---|---|
| 4017640A1 | 12/1990 | Fed. Rep. of Germany . |
| 4019683A1 | 1/1991 | Fed. Rep. of Germany . |

*Primary Examiner*—Patrick J. Ryan
*Assistant Examiner*—Marie R. Macholl
*Attorney, Agent, or Firm*—Armstrong, Westerman, Hattori, McLeland & Naughton

[57] ABSTRACT

A rewritable thermosensitive recording medium having a recording layer, the transparency of which reversibly changes depending on the temperature thereof. Further, the recording layer contains a matrix material and an organic low-molecular-weight material dispersed in the matrix material as main components thereof. Moreover, an alicyclic dicarboxylic acid compound is added to the organic low-molecular-weight material dispersed in the matrix material. Furthermore, by adding the alicyclic dicarboxylic acid compound to the organic low-molecular-weight material, the eutectic point of the organic low-molecular-weight material and the alicyclic dicarboxylic acid compound becomes higher than the melting point of the organic low-molecular-weight material. Additionally, in spite of the fact that the amount of the alicyclic dicarboxylic acid compound to be added to the organic low-molecular-weight material is small, the difference between the eutectic point of the organic low-molecular-weight material and the alicyclic dicarboxylic acid compound and the melting point of the organic low-molecular-weight material is much larger than those obtained in cases of conventional recording materials. Consequently, the range of temperature, to which the recording layer should be heated for changing a state thereof from an opaque state to a transparent state, can be considerably enlarged without reducing the opacity of the recording layer.

6 Claims, 3 Drawing Sheets

FIG. 3

| EMBODIMENT NO. | BEHENIC ACID (P) | EICOSANE DIACID (P) | ALIPHATIC DICARBOXYLIC ACID (P) | TOTAL WEIGHT (P) |
|---|---|---|---|---|
| 10 | (6) | (1) | (1) | 100 |
| 11 | (10) | (2) | (1) | 100 |
| 12 | (8) | (2) | (1) | 100 |
| 13 | (7) | (2) | (1) | 100 |
| 14 | (7) | (3) | (1) | 100 |

P:PARTS BY WEIGHT

FIG. 4

| NO. | TRANSPARENCY TEMPERATURE RANGE (℃) | TRANSPARENCY TEMPERATURE WIDTH | MAXIMUM TRANSPARENCY | MAXIMUM OPACITY |
|---|---|---|---|---|
| E1 | 78～121 | 43 | 1.27 | 0.12 |
| E2 | 79～129 | 50 | 1.25 | 0.15 |
| E3 | 79～143 | 64 | 1.08 | 0.18 |
| E4 | 75～110 | 35 | 1.25 | 0.15 |
| E5 | 76～145 | 69 | 1.19 | 0.16 |
| E6 | 75～152 | 77 | 1.20 | 0.17 |
| E7 | 74～142 | 68 | 1.17 | 0.18 |
| E8 | 74～138 | 64 | 1.17 | 0.17 |
| E9 | 74～141 | 67 | 1.82 | 0.20 |
| E10 | 74～148 | 72 | 1.77 | 0.21 |
| E11 | 75～122 | 47 | 1.75 | 0.18 |
| E12 | 74～132 | 58 | 1.83 | 0.19 |
| E13 | 74～140 | 66 | 1.97 | 0.22 |
| E14 | 76～124 | 48 | 1.96 | 0.23 |
| C1 | 71～77 | 6 | 1.77 | 0.31 |
| C2 | 70～83 | 13 | 1.78 | 0.34 |
| C3 | 73～92 | 19 | 1.80 | 0.40 |
| C4 | 67～75 | 8 | | |
| C5 | 72～78 | 6 | | |
| C6 | 73～94 | 21 | | |

E:EMBODIMENT
C:COMPARATIVE EXAMPLE

REWRITABLE THERMOSENSITIVE RECORDING MEDIUM

BACKGROUND OF THE INVENTION

1. Field of the Invention

This invention generally relates to a rewritable thermosensitive recording medium provided with a recording layer, the transparency of which reversibly changes depending on the temperature thereof. More particularly, this invention relates to an improved thermosensitive recording medium that can considerably enlarge the range of a transparent state in terms of the temperature, namely, the range (hereunder referred to simply as a transparency temperature range) of temperature, to which a recording layer should be heated for changing a state thereof from an opaque state to a transparent state, and moreover can hardly cause reduction in contrast between a portion of an image corresponding to an object (hereunder sometimes referred to simply as an object image portion) and the remaining portion (hereunder sometimes referred to simply as a ground image portion) thereof.

2. Description of the Related Art

As is described in the U.S. Pat. Nos. 4,268,413 and 4,695,528, a conventional thermosensitive recording medium of this kind has a structure in which a recording layer containing a thermoplastic resin (for example, polyvinyl chloride) and organic low-molecular-weight materials (for instance, a higher fatty acid) dispersed in the thermoplastic resin as principal components thereof is formed on a support.

Further, this conventional thermosensitive recording medium is made by dexterously utilizing the property of the recording layer that the light absorption characteristic of the recording layer (namely, the intensity of light scattered by the recording layer) varies reversibly depending on the temperature thereof. Namely, in case of this recording layer, there are two state conversion temperatures $T_1$ and $T_2$ (incidentally, $T_1<T_2$), which are higher than a specific temperature $T_0$ close to room temperature. When this recording layer is heated to a temperature equal to or higher than the temperature $T_2$, this recording layer becomes translucent. Thereafter, when this recording layer is cooled to the temperature $T_0$ or below, this recording layer becomes whitely opaque. Thus the intensity of light scattered by the recording layer increases and the recording layer reaches a maximum light extinction state (namely, a maximum opacity state). In contrast, when this recording layer is heated to a temperature, which is equal to or higher than the state conversion temperature $T_1$ and lower than that $T_2$, the intensity of light scattered by this recording layer decreases and thus this recording layer enters a transparent state. Further, such a transparent state is maintained when this recording layer is cooled to the temperature $T_0$ or below. Moreover, the maximum light extinction state and the transparent state of this recording layer can be maintained at the specific temperature $T_0$ or below. Furthermore, the state of this recording layer can be reversibly changed between these states. Additionally, an opaque portion of this recording layer (namely, a portion put in the maximum light extinction state) can be distinguished from a transparent portion of this recording layer (namely, another portion put in the transparent state). Therefore, by setting one of these states as a base state (for example, by setting the maximum light extinction state as a base state corresponding to a white ground portion of an image), the conventional thermosensitive recording medium can be used as a rewritable recording medium.

Incidentally, hereinafter, the temperature range between the state conversion temperatures $T_1$ and $T_2$ will be sometimes referred to as the transparency temperature-range because the recording layer can be put in the transparent state by heating the recording layer to any temperature of this temperature range.

Such a conventional thermosensitive recording medium, however, has a drawback in that the transparency temperature range is very narrow, namely, 2 to 4 degrees or so in case of employing the centigrade scale and thus the control of the temperature thereof is extremely difficult when the whole or a part of the recording layer, which is in a whitely opaque state (namely, a milky white state), is heated to a temperature equal to or higher than the temperature $T_1$ and lower than the temperature $T_2$ to put the recording layer in the transparent state.

Then, in order to enlarge the transparent-state realization temperature-range, the U.S. Pat. No. 4,917,948 has proposed a reversible thermosensitive recording medium in which at least one higher fatty acid having 16 or more carbon atoms and at least one aliphatic saturated dicarboxylic acid or a derivative thereof are employed as the organic low-molecular-weight materials. Further, the U.S. Pat. No. 5,085,934 has proposed another reversible thermosensitive recording medium in which at least one higher fatty acid having 16 or more carbon atoms and at least one aliphatic saturated dicarboxylic acid having 20 or more carbon atoms are employed as the organic low-molecular-weight materials.

Thereby, the transparency temperature-range can be indeed enlarged a little.

However, as is apparent from data on the transparency temperature ranges of comparative examples (to be described later), the enlarged transparency temperature ranges are 20 degrees or so in case of employing the centigrade scale and thus are yet too narrow to completely eliminate the foregoing drawback of the conventional thermosensitive recording medium. Moreover, this results in that the conventional thermosensitive recording medium has another drawback as will be described hereinbelow. Namely, although it is theoretically possible that a transparent portion representing an object is formed in whitely opaque portions representing white grounds in such a thermosensitive recording medium by using a heating means such as a thermal head, the transparency temperature state is narrow yet and thus it is practically difficult to set a heating temperature of the heating means such as a thermal head within the transparency temperature range at a high speed. Therefore, it is usual to perform a method in which the thermosensitive recording medium is first inserted between heating rollers preliminarily heated to a suitable temperature within the transparency temperature range and as a result, becomes uniformly transparent and thereafter a portion of the recording layer is selectively put into the whitely opaque state by using the heating means such as the thermal head preliminarily heated to a temperature equal to or higher than the temperature $T_2$ and as a result, a whitely opaque portion representing the object is formed in portions representing transparent grounds or bases.

Thus the image formed and recorded by effecting such a method is a reverse image (namely, what is called a negative pattern) of an ordinary picture draft. Therefore, the conventional thermosensitive recording medium has another fatal drawback in that the application thereof is limited to a special technical field.

Moreover, in case of enlarging the transparency temperature range by employing the reversible thermosensitive recording medium proposed in the official gazettes of the U.S. Pat. Nos. 4,917,948 and 5,085,934, as is apparent from data on the transparency temperature range described in the official gazettes of the U.S. Pat. Nos. 4,917,948 and 5,085,934, if a mixing rate of the amount of the aliphatic saturated dicarboxylic acid to that of the higher fatty acid is low, the transparency temperature range is enlarged only a little.

In contrast, as the mixing rate of the amount of the aliphatic saturated dicarboxylic acid to that of the higher fatty acid increases, the transparency temperature range becomes larger. On the other hand, as the mixing rate of the amount of the aliphatic saturated dicarboxylic acid increases and that of the higher fatty acid decreases, the opacity of the object image portion of the recording layer is liable to decrease (see TABLE 2 of U.S. Pat. No. 5,085,934). Therefore, the conventional thermosensitive recording medium has another drawback in that the sufficient contrast between the whitely opaque portion and the transparent portion, which correspond to the object image portion and the ground image portion, respectively, cannot be obtained. The present invention is accomplished to eliminate the foregoing drawbacks of the conventional thermosensitive recording medium.

SUMMARY OF THE INVENTION

It is, accordingly, an object of the present invention to provide an improved rewritable thermosensitive recording medium which can considerably enlarge the transparency temperature range and moreover can hardly cause reduction in contrast between the object image portion and the ground image portion thereof.

To achieve the foregoing object, in accordance with the present invention, there is provided a rewritable thermosensitive recording medium having a recording layer, the transparency of which reversibly changes depending on the temperature thereof, the recording layer containing a matrix material (e.g., a matrix resin) and organic low-molecular-weight materials dispersed in the matrix material as main components thereof, the rewritable thermosensitive recording medium, characterized in that the organic low-molecular-weight materials include an alicyclic dicarboxylic acid compound.

Further, in an embodiment of such a rewritable thermosensitive recording medium, thermoplastic resins, which have refractive indexes close to those of organic low-molecular-weight materials, alicyclic dicarboxylic acid compounds and aliphatic dicarboxylic acid compounds as will be cited later and is not compatible with such materials and compounds (namely, there is no compatibility between the thermoplastic resins and such materials and compounds) and has satisfactory mechanical strength, film-forming capability and favorable transparency, are employed as materials in the matrix material composing a part of the recording layer. Practical examples of such thermoplastic resins are as follows: polyester resins such as saturated polyester copolymers; polyvinyl chloride resins; vinyl chloride copolymers such as vinyl chloride-vinyl acetate copolymers, vinyl chloride-vinyl acetate-vinyl alcohol copolymers, vinyl chloride-vinyl acetate-maleic acid copolymers and vinyl chloride-acrylate copolymers; polyvinylidene chloride resins; vinylidene chloride copolymers such as vinylidene chloride-vinyl chloride copolymers and vinylidene chloride-acrylic nitrile copolymers; polyamide resins; silicon resins; and polyacrylate or polymethacrylate resins or their copolymers. Incidentally, these thermoplastic resins may be employed either alone or in combination as the materials in the matrix material.

Moreover, thermosetting resins, which contain a hydroxyl denatured vinyl chloride-vinyl acetate copolymer and an isocyanate compound and have refractive indexes close to those of the organic low-molecular-weight materials, the alicyclic dicarboxylic acid compounds and the aliphatic dicarboxylic acid compounds as will be cited later but are not compatible with such materials and compounds and has favorable transparency, may be also employed as the materials in the matrix material.

Here, note that the hydroxyl denatured vinyl chloride-vinyl acetate copolymer is a vinyl chloride-vinyl acetate copolymer, to which 0.5 to 10% by weight of hydroxyl groups (—OH) are introduced. Examples of the hydroxyl denatured vinyl chloride-vinyl acetate copolymer are a vinyl chloride-vinyl acetate-vinyl alcohol copolymer and vinyl chloride-vinyl acetate-"alkyl acrylate having hydroxyl groups" copolymers such as a vinyl chloride-vinyl acetate-hydroxyalkyl acrylate copolymer. On the other hand, isocyanate compounds, which have isocyanate groups (—N=C=O) and are universally and widely used as crosslinking agents, may be employed to form a matrix material, namely, a thermosetting resin by reacting with the hydroxyl groups of the hydroxyl denatured vinyl chloride-vinyl acetate copolymer. Practical examples of such isocyanate compounds are as follows: toluylenediisocyanate; dimers of 2, 4 tolurlenediisocyanate; naphthylene-1,5-diisocyanate; o-toluylenediisocyanate; diphenylmethanediisocyanate; triphenylmethanetriisocyanate; tris-p-isocyanatephenyl thiophosphite; polymethylenepolyphenylisocyanate; multifunctional aromatic isocyanate; aromatic polyisocyanate; hexamethylenediisocyanate; trimethylhexamethylenediisocyanate; multifunctional aliphatic isocyanate; isophoronediisocyanate; and xylylenediisocyanate.

Next, the organic low-molecular-weight materials dispersed in the matrix material are organic compounds, each of which contains at least one of oxygen, sulfur, nitrogen and halogen atoms and has 10 to 40 carbon atoms, a molecular weight of 100 to 700 and a melting point (hereunder sometimes abbreviated as mp) of 50 to 150 degrees Centigrade (° C.). Practical examples of such organic compounds are as follows: higher alcohols such as alkanoles, alkandioles, halogen alkanoles and halogen alkandioles; higher aliphatic amines; alkanes, alkenes, alkines and their halogen substitution products; cyclic compounds such as cycloalkanes, cycloalkenes and cycloalkines; saturated carboxylic acids, unsaturated monocarboxylic acids, saturated and unsaturated dicarboxylic acids or their esters, amides or ammonium salts; saturated or unsaturated halogen fatty acids or their esters, amides or ammonium salts; halogen allyl carbonic acids or their esters, amides or ammonium salts; thio alcohols or their carboxylic acid esters; and thio carbonic acids or their esters, amides or ammonium salts. Incidentally, these compounds may be employed either alone or in combination as the organic low-molecular-weight materials dispersed in the matrix material.

On the other hand, the alicyclic dicarboxylic acid compounds are compatible with the organic low-molecular-weight material but are not compatible with the matrix material. Practical examples of such compounds are as follows: cyclopropane dicarboxylic acids and their isomers such as 1,1-cyclopropane dicarboxylic acid (incidentally, mp is 140° C.), 1,2-cis-cyclopropane dicarboxylic acid (mp is 139° C.) and 1,2-transcyclopropane dicarboxylic acid (mp is 175° C.); cyclobutane dicarboxylic acids and their isomers such as 1,1-cyclobutane dicarboxylic acid (mp is 157° C.), 1,2-cis-cyclobutane dicarboxylic acid (mp is 138° C.), 1,2-trans-cyclobutane dicarboxylic acid (mp is 137° C.), 1,3-cis-cyclobutane dicarboxylic acid (mp is 143° C.) and 1,3-trans-cyclobutane dicarboxylic acid (mp is 171° C.); cyclopentane dicarboxylic acids and their isomers such as 1,1-cyclopentane dicarboxylic acid (mp is 184° C.), 1,2-cis-cyclopentane dicarboxylic acid (mp is 140° C.), 1,2-trans-cyclopentane dicarboxylic acid (mp is 181° C.), 1,3-cis-cyclopentane dicarboxylic acid (mp is 121° C.) and 1,3-trans-cyclopentane dicarboxylic acid (mp is 188° C.); and cyclohexane dicarboxylic acids and their isomers such as 1,2-cis-cyclohexane dicarboxylic acid (mp is 170° C.), 1,2-trans-cyclohexane dicarboxylic acid (mp is 310° C.), 1,3-cis-cyclohexane dicarboxylic acid (mp is 187° C.), 1,3-trans-cyclohexane dicarboxylic acid (mp is 148° C.), 1,4-cis-cyclohexane dicarboxylic acid (mp is 192° C.) and 1,4-trans-cyclohexane dicarboxylic acid (mp is 221° C.).

Further, as the result of adding the alicyclic dicarboxylic acid compound to the organic low-molecular-weight material, the eutectic point of the organic low-molecular-weight material and the alicyclic dicarboxylic acid compound becomes higher than the melting point of the organic low-molecular-weight material. Moreover, the difference between the eutectic point of the organic low-molecular-weight material and the alicyclic dicarboxylic acid compound and the melting point of the organic low-molecular-weight material is much larger than those obtained in cases of the conventional recording materials described in the U.S. Pat. Nos. 4,917,948 and 5,085,934. Thus the transparency temperature range can be considerably enlarged.

Incidentally, in case where a mixture of a cis-alicyclic-dicarboxylic acid compound and a trans-alicyclic-dicarboxylic acid compound is employed as the alicyclic dicarboxylic acid compound to be added to the organic low-molecular-weight material dispersed in the matrix material, the transparency temperature range can be further enlarged in comparison with case where only one of the cis-alicyclic-dicarboxylic acid compound and the trans-alicyclic-dicarboxylic acid compound. In the former case, a cis-alicyclic-dicarboxylic acid compound and a trans-alicyclic-dicarboxylic acid compound of the same kind (for example, a 1,2-cis-cyclopropane dicarboxylic acid compound and a 1,2-trans-cyclopropane dicarboxylic acid compound) may be employed as the components of the mixture. Moreover, a cis-alicyclic-dicarboxylic acid compound and a trans-alicyclic-dicarboxylic acid compound of different kinds (for example, a 1,2-cis-cyclopropane dicarboxylic acid compound and a 1,3-trans-cyclobutane dicarboxylic acid compound) may be employed as the components of the mixture. Incidentally, in the mixture, a ratio (hereunder sometimes referred to as a mixing ratio) of the amount of the cis-alicyclic-dicarboxylic acid compound to that of the trans-alicyclic-dicarboxylic acid compound can be freely established. However, as is apparent from data on embodiments of the present invention (to be described later), the rewritable thermosensitive recording medium of the present invention has a maximum transparency temperature range in case that the mixing ratio is 1:1.

Meanwhile, when the alicyclic dicarboxylic acid compound is added to the organic low-molecular-weight material, the transparency temperature range can be considerably enlarged by adding as above described, but the transparency of the recording layer containing the matrix material and the organic low-molecular-weight material may decrease a little. Such a decrease in transparency of the recording layer can be prevented by adding not only the alicyclic dicarboxylic acid compound but also an aliphatic dicarboxylic acid compound to the organic low-molecular-weight material. Practical examples of such an aliphatic dicarboxylic acid compound are as follows: succinic acids; glutaric acids; adipic acids; pimelic acids; suberic acids; azelaic acids; sebacic acids; undecane diacide; dodecane diacids; tridecane diacids; tetradecane diacids; pentadecane diacids; hexadecane diacids; heptadecane diacids; octadecane diacids; nonadecane diacids; eicosane diacids; heneicosane diacids; docosane diacids; tricosane diacids; tetracosane diacids; pentacosanoic diacids; and hexacosanoic acids.

Further, such matrix materials, organic low-molecular-weight materials, alicyclic dicarboxylic acid compounds and aliphatic dicarboxylic acid compounds are dissolved in an organic solution of methyl ethyl ketone, methyl isobutyl ketone, chloroform, ethanol, benzene, toluene, tetrahydrofuran, carbon tetrachloride and so forth. Then, this solution is coated on the support (to be described later), and subsequently the coated support is dried up. Alternatively, the organic low-molecular-weight materials, alicyclic dicarboxylic acid compounds and aliphatic dicarboxylic acid compounds, which are uniformly mixed with one another maintaining the compatibility among them, are dispersed like fine grains in a solution, in which the matrix materials are dissolved, to make a mixture. Then, such a mixture is coated on the support and thereafter, the coated support is dried up. Thus the recording layer, the transparency of which reversibly changes depending on the temperature thereof, is formed.

Here, note that it is preferable that the amount of the alicyclic dicarboxylic acid compound, which is added to the organic low-molecular-weight material, based on the total amount of the alicyclic dicarboxylic acid compound and the organic low-molecular-weight material (or to the total amount of the alicyclic dicarboxylic acid compound, the organic low-molecular-weight material and the aliphatic dicarboxylic acid compound) be 2 to 30% by weight. If the amount added is less than 2% by weight, the action of the added alicyclic dicarboxylic acid compound is not enough and thus the transparency temperature range cannot be enlarged sufficiently. On the other hand, if the amount added exceeds 30% by weight, the transparency temperature range can be greatly enlarged, but the opacity of the recording layer is reduced as the amount added is increased.

The ratio by weight of the amount of the organic low-molecular-weight material, including the alicyclic dicarboxylic acid compound, to the amount of the matrix material is 1:2 to 1:6.

Thus, the rewritable thermosensitive recording medium of the present invention has an advantage in that the transparency temperature range is considerably enlarged in comparison with the conventional recording media disclosed in the U.S. Pat. Nos. 4,917,948 and 5,085,934. Further, the rewritable thermosensitive recording medium of the present invention has additional advantages in that even if the addition ratio is small (namely, 2 to 30% by weight), the alicyclic dicarboxylic acid compound functions sufficiently and thus the reduction in opacity of the recording layer becomes hard to occur and in that the reduction in transparency of the recording layer can be prevented by further adding the aliphatic dicarboxylic acid compound to the organic low-molecular-weight material.

Further, dyes, ultra-violet-rays absorbents or infrared-rays absorbents may be added into the recording layer with the intention of improving the optical properties of the recording layer, similarly as in cases of the conventional recording media. Moreover, plasticizers and surface-active agents may be added thereto for the purpose of improving the plasticity and the surface activeness (namely, the coefficient of friction of the surface) thereof, similarly as in cases of the conventional recording media.

Furthermore, a protective layer containing fluororesins, silicone resins or the like may be provided on the recording layer, similarly as in the conventional recording media, with a view to improving printability with the thermal printer, as well as the durability of the surface of the recording layer against iterative rewriting operations. In such a case, acrylic resins obtained by hardening an aqueous emulsion, the main component of which is an acrylic oligomer having an acryloyl group ($CH_2{=}CHCO{-}$) or a methacryloyl group ($CH_2{=}C(CH_3)CO{-}$) at an end or side chain thereof, by irradiating ultra violet rays or electron beams may be employed instead of the fluororesins used by being dissolved or dispersed in an organic solvent. The employment of such an aqueous material as a material of the protective layer has a merit in that in contrast with the case of employing the organic material, there is no fear that oligomers, aqueous solvents or the like soak into the recording layer, and thus the initial state of the organic low-molecular-weight materials dispersed in the recording layer can be maintained before and after the protective layer is formed.

Incidentally, oligomers obtained as results of denaturization by using urethane, polyester, polyether, epoxide, silicone or the like may be employed as the acrylic oligomer. Hereinafter, such acrylic oligomers will be described individually.

(1) Polyurethane Acrylate

Polyurethane acrylate is a polymer (namely, an oligomer) obtained by reacting polyols (of the polyester type and the polyether type), diisocyanates and acrylates (or methacrylates) having hydroxyl groups with one another. Structural formulae of examples of the polyurethane acrylate are described below. Incidentally, in these formulae, character R denotes H or $CH_3$; and TDI tolyenediisocyanate.

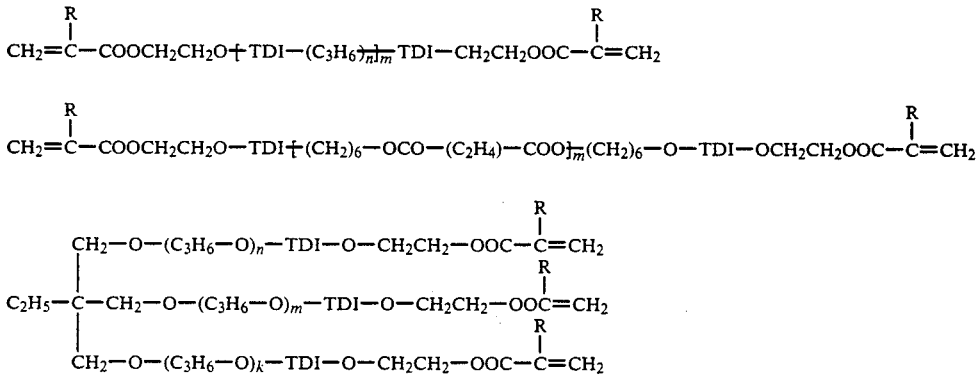

(2) Polyester Acrylate

Polyester acrylate is a polymer (namely, an oligomer) obtained by introducing acryloyl or methacryloyl groups to polyesters synthesized from polyhydric alcohols and polybasic acids. Structural formulae of examples of the polyurethane acrylate are described below. Incidentally, in these formulae, character R denotes H or $CH_3$.

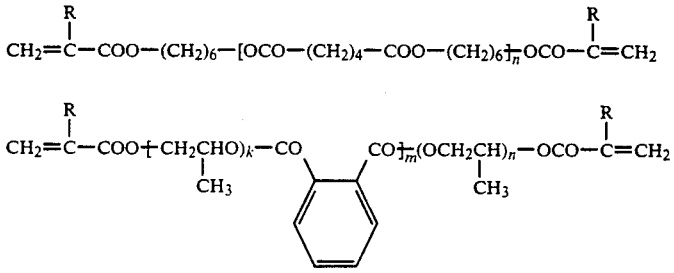

-continued

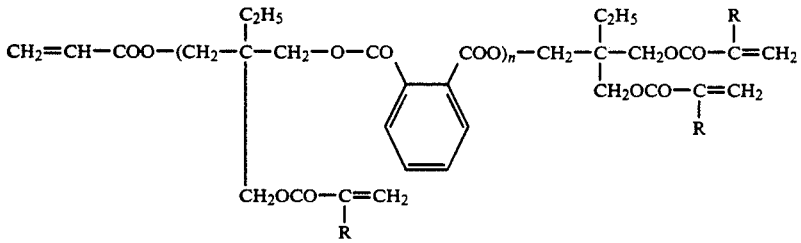

(3) Epoxy Acrylate

Epoxy acrylate is a polymer (namely, an oligomer) obtained by reacting epoxy resins with acrylic or methacrylic acids. Further, examples of such epoxy acrylate are bisphenol A, bisphenol F, bisphenol S, phenol-novolac epoxy acrylate and alicyclic epoxy acrylate (or alicyclic epoxy acrylate), the structural formulae of which are shown hereinbelow.

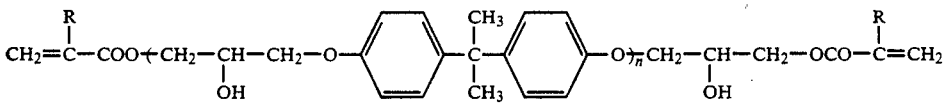

(incidentally, R: H or $CH_3$)

Bisphenol A: 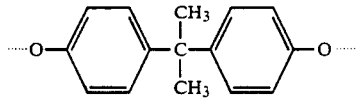

Bisphenol F: 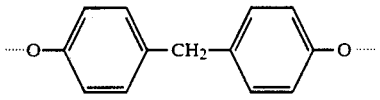

Bisphenol S: 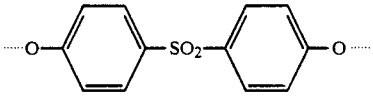

Phenol-novolac Epoxy Acrylate: 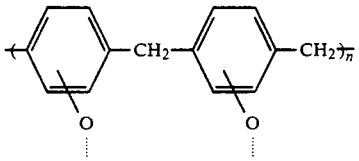

Alicyclic Epoxy Acrylate: 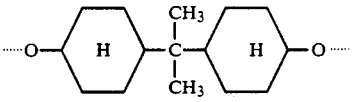

(4) Silicone Resin Acrylate

Silicone resin acrylate is a polymer (namely, an oligomer) obtained by introducing acryloyl groups or methacryloyl groups to polysiloxanes. The structural formulae of examples of the silicone resin acrylate are described hereinbelow.

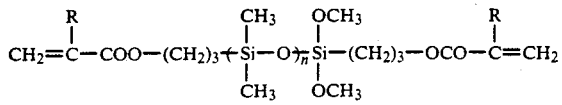

-continued

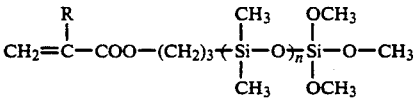

In case where the thermosetting resins, which contain a hydroxyl denatured vinyl chloride-vinyl acetate copolymer and an isocyanate compound and have refractive indexes close to those of the organic low-molecular-weight materials, the alicyclic dicarboxylic acid compounds and the aliphatic dicarboxylic acid compounds but are not compatible with such materials and compounds and has favorable transparency, are employed as the matrix materials of the recording layer, such thermosetting resins have a good thermal resistance, large mechanical strength and a favorable adhesive property of adhering to the support such as a plastic sheet and paper. Thus, in comparison with the case of employing the thermoplastic resin as the matrix material, the heat deterioration of the recording layer becomes hard to occur, and moreover it becomes possible to maintain the initial state of the organic low-molecular-weight materials dispersed in the recording layer for a long time. Consequently, the rewritable thermosensitive recording medium of the present invention has advantages in that the reduction in opacity of the recording layer attended with the heat deterioration thereof can be prevented, that the durability of the surface of the recording layer against iterative rewriting operations can be improved and that the present invention can save the protective layer from being formed.

Incidentally, in case that the thermal setting resin is employed as the matrix material of the recording layer, as is apparent from data on the comparative examples (to be described later), the transparency temperature range becomes narrower in comparison with the case of employing the thermoplastic resin.

However, compared with the conventional recording media, the recording medium of the present invention can considerably enlarge the transparency temperature range by adding the alicyclic dicarboxylic acid compound to the organic low-molecular-weight material. Thus, even when offsetting the considerable increase in the transparency temperature range due to the addition of the alicyclic dicarboxylic acid compound against the reduction therein due to the employment of the thermosetting resin, a large increase therein is still left. Therefore, the rewritable thermosensitive recording medium of the present invention has no defects in characteristics thereof.

Further, a support similar to that of the conventional recording medium may be employed in the recording medium of the present invention. Examples of such a support are as follows: a transparent plastic film or sheet; a plastic film or sheet mixed with colorants such as dyes and pigments; a plastic film or sheet covered by a colored layer made of coating materials containing dyes and pigments or of ink; and a plastic film (or sheet) or paper provided with a light reflecting metal layer containing metals such as aluminum, tin, silver, magnesium, chromium and nickel. Furthermore, practical examples of the material of the plastic film or sheet are polyethylene terephthalate; polyethylene naphthalate; polycarbonate; and polyparabanic acid. Each of such materials has good thermal resistance, transparency and mechanical strength.

Incidentally, in case that such a light reflecting metal layer is formed on the plastic film (or sheet) or paper as a film, an adhesive layer made of adhesives intervenes between this light reflecting metal layer and the recording layer formed thereon as a film, for the purpose of raising adhesive force. For instance, conventionally used materials such as polyester resins, acrylic polyol resins and vinyl chloride-vinyl acetate copolymer resins containing phosphoric ester groups may be employed as the adhesives. In addition to these materials, a thermoplastic polyparabanic acid resin, which has good thermal resistance, solvent resistance and adhesion to metals and is represented by a structural formula described below, may be used as the adhesives. Namely, in case of employing this polyparabanic acid resin, this resin has substantially no thermal shrinkage action when forming the adhesive layer. Thus neither cracks nor pinholes are formed in the light reflecting metal layer. Thereby, the reflection density of the light reflecting metal layer can be prevented from being reduced. Moreover, this resin is hard to be dissolved and swelled by organic solvents such as tetrahydrofuran. Thus there is substantially no fear that the organic solvents for forming the recording layer soak into the adhesive layer. Therefore, the reduction in reflection density of the light reflecting metal layer can be further prevented. Furthermore, this resin has good adhesion to metals as above described and thus has a merit in that an occurrence of an exfoliation phenomenon, in which the adhesive layer is exfoliated from the light reflecting metal layer, can be prevented.

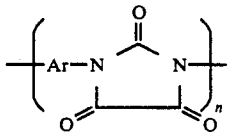

Incidentally, characters Ar denote one of the following materials:

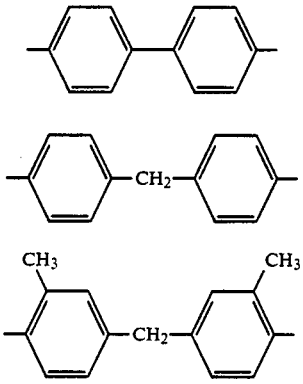

Thus, in case of the recording medium of the present invention, the alicyclic dicarboxylic acid compound is added to the organic low-molecular-weight material. As the result, the eutectic point of the organic low-molecular-weight material and the alicyclic dicarboxylic acid compound becomes higher than the melting point of the organic low-molecular-weight material. Moreover, the difference between the eutectic point of the organic low-molecular-weight material and the alicyclic dicarboxylic acid compound and the melting point of the organic low-molecular-weight material is much larger than those obtained in cases of the conventional recording materials. Consequently, the transparency temperature range can be considerably enlarged.

Further, even in case where the addition ratio of the alicyclic dicarboxylic acid compound is small, the transparency temperature range can be sufficiently enlarged in comparison with those of the conventional recording media. Thus, when the addition ratio of the alicyclic dicarboxylic acid compound is small, the reduction in opacity of the recording layer can be prevented.

Consequently, it becomes easy to set the heating temperature of the heating means such as a thermal head within the transparency temperature range at a high speed. Thus the formation of a transparent object image with a white ground image (namely, an image portion put in a milky white state) for a background, as well as that of a white object image with a transparent ground image portion (namely, an image portion put in a transparent state), can be easily achieved. As a consequence, the range of application of the recording medium of this kind can be widened. Furthermore, in case of the recording medium of the present invention, the reduction in contrast between an object image portion and a ground image portion is hard to occur. Thus, recording picture quality can be improved.

BRIEF DESCRIPTION OF THE DRAWINGS

Other features, objects and advantages of the present invention will become apparent from the following description of preferred embodiments with reference to the drawings in which like reference characters designate like or corresponding parts throughout several views, and in which:

FIG. 3 is a diagram for showing the relation among the mixing rates of behenic acid, eicosane diacid and alicyclic dicarboxylic acid compound of the recording layer of each of Embodiments 10 to 14; and FIG. 4 is a diagram for showing results of experiments on Embodiments 1 to 14 and Comparative Examples 1 to 6.

DETAILED DESCRIPTION OF THE PREFERRED EMBODIMENTS

Hereinafter, the preferred embodiments of the present invention will be described in detail by referring to the accompanying drawings.

Incidentally, in the following descriptions of the preferred embodiments and comparative examples, compounded components will be represented in terms of "parts by weight" (hereunder referred to simply as parts) and "% by weight".

1. Embodiment 1

Figure 1:
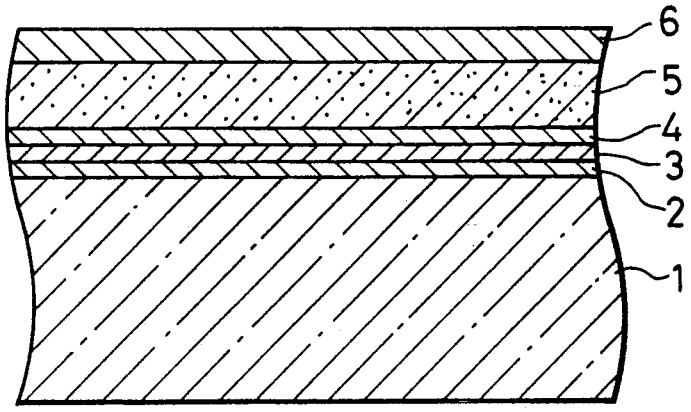
FIG. 1 is a sectional view of a thermosensitive recording medium embodying the present invention.

As shown in FIG. 1, the principal portion of this embodiment or example of the thermosensitive recording medium embodying the present invention comprises: a support 1 consisting of a transparent polyester sheet; an anchoring layer 2 mounted on this support 1; a light reflecting metal layer 3 provided on this anchoring layer 2; an adhesive layer 4 formed on this light reflecting metal layer 3; a recording layer 5 mounted on this adhesive layer 4; and a protective layer 6 provided on this recording layer 5.

Further, this thermosensitive recording medium is produced by going through the following process.

Namely, components of the anchoring layer (to be described later) are first coated on the support 1 formed by a polyester sheet having a thickness of 150 micrometers (μm) by using a wire bar. Then, such a coat formed on the support 1 is dried and thermally set at 100° C. for 5 minutes to form the anchoring layer 2, the dry thickness of which is 1.5 μm. Subsequently, a vacuum deposition of aluminum on the top surface of the anchoring layer 2 is performed to form the light reflecting metal layer 3, the thickness of which is 500 Å. Thereafter, components of the adhesive layer 4 are coated on this light reflecting metal layer 3 by using the wire bar. Then, the coated surface of the layer 3 is dried at 90° C. for 5 minutes to form the adhesive layer 4, the dry thickness of which is 0.5 μm.

Next, components (to be described later) of the recording layer, which are uniformly dissolved, are coated on this adhesive layer 4 by using the wire bar. Then, the coated surface of the adhesive layer 4 is dried at 110° C. for 3 minutes to form the recording layer 5, the dry thickness of which is 9 μm. Subsequently, components (to be described later) of the protective layer 6 are coated on this recording layer 5 by using the wire bar. Then, the coated surface of the recording layer 5 is dried at 90° C. for 3 minutes. Thereafter, this support 1 is put on and moved at a speed of 10 meters/minute (m/min) by a conveyer. Moreover, ultraviolet rays are uniformly irradiated from a high-pressure mercury lamp of the ozone converging type of 80 Watts/centimeters (W/cm) onto the support 1 to form the protective layer 6, the polymerization thickness of which is 2.5 μm, by performing the photopolymerization of the components thereof. Thus the thermosensitive recording medium is completed.

Incidentally, the composition of the anchoring layer 2 is as follows:

| | |
|---|---|
| Polyester resin ("Vylon #200" of TOYOBO Co., Ltd.) | 10 parts |
| Isocyanate a hardening agent "DURANATE 24A-100" of ASAHI CHEMICAL INDUSTRY Co., Ltd.) | 0.1 parts |
| Triethylenediamine (a hardening accelerator) | 0.01 parts |
| Toluene | 45 parts |
| 2-butanone | 45 parts. |

Further, the composition of the adhesive layer 4 is as follows:

| | |
|---|---|
| Polyparabanic acid resin ("PPA - D" of NITTO CHEMICAL INDUSTRY Co., Ltd., having the following structural formula:) | 10 parts |

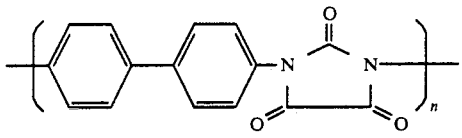

| | |
|---|---|
| Acetone | 80 parts |
| Dioxane | 10 parts. |

Moreover, the composition of the recording layer 5 is as follows:

| | |
|---|---|
| Behenic acid | 95 parts |
| Alicyclic dicarboxylic acid compound (1,4-cis-cyclohexane dicarboxylic acid) | 5 parts |
| Vinyl chloride - vinyl acetate copolymer ("S-lec C" of SEKISUI CHEMICAL Co., Ltd.) | 300 parts |
| Toluene | 300 parts |
| Tetrahydrofuran | 1200 parts. |

Furthermore, the composition of the protective layer is as follows:

| | |
|---|---|
| Multifunctional polyesteracrylate emulsion (Solid portion: 40% by weight ("M - 8060 Emulsion" of TOAGOUSEI CHEMICAL INDUSTRY Co., Ltd.)) | 100 parts |
| Lubricant (Special macromolecular resin solution, Solid portion: 50% by weight ("BYK - 301" of BYK-CHEMIE (JAPAN) Co., Ltd.)) | 5 parts |
| Initiator ("Irgacure 651" of CIBA-GEIGY (JAPAN) | 2 parts |

-continued

| |
|---|
| LIMITED.) |

2. Embodiment 2

This embodiment is almost the same as Embodiment 1 except that the recording layer contained:

| | |
|---|---|
| Behenic acid | 90 parts |
| Alicyclic dicarboxylic acid compound (1,4-cis-cyclohexane dicarboxylic acid). | 10 parts |

3. Embodiment 3

This embodiment is almost the same as Embodiment 1 except that the composition of the recording layer is as follows:

| | |
|---|---|
| Behenic acid | 90 parts |
| Mixture of cis- and trans-alicyclic dicarboxylic acid compounds (incidentally, 1,4-cis-cyclohexane dicarboxylic acid: 8 parts; and 1,4-trans-cyclohexane dicarboxylic acid: 2 parts) | 10 parts |
| Vinyl chloride-vinyl acetate copolymer ("S-lec C" of SEKISUI CHEMICAL Co., Ltd.) | 300 parts |
| Toluene | 300 parts |
| Tetrahydrofuran | 1200 parts. |

4. Embodiment 4

This embodiment is almost the same as Embodiment 1 except that components (to be described below) of the recording layer 5 are coated on the adhesive layer 4 and then such a coat formed on the adhesive layer 4 is dried and thermally set at 100° C. for 5 minutes to form the recording layer 5, the thermally-set thickness of which is 9 μm.

Incidentally, the composition of the recording layer 5 is as follows:

| | |
|---|---|
| Behenic acid | 90 parts |
| Mixture of cis- and trans-alicyclic dicarboxylic acid compounds (incidentally, 1,4-cis-cyclohexane dicarboxylic acid: 8 parts; and 1,4-trans-cyclohexane dicarboxylic acid: 2 parts) | 10 parts |
| Vinyl chloride-vinyl acetate-vinyl alcohol copolymer ("S-lec A" of SEKISUI CHEMICAL Co., Ltd.) | 300 parts |
| Isocyanate (a hardening agent "DURANATE 24A-100" of ASAHI CHEMICAL INDUSTRY Co., Ltd.) | 30 parts |
| Triethylenediamine (a hardening accelerator) | 3 parts |
| Toluene | 300 parts |
| Tetrahydrofuran | 1200 parts. |

5. Embodiment 5

This embodiment is almost the same as Embodiment 4 except that the composition of the mixture of the cis- and trans-alicyclic dicarboxylic acid compounds (10 parts) of the recording layer is composed as follows:

| | |
|---|---|
| 1,4-cis-cyclohexane dicarboxylic acid and | 6 parts; |
| 1,4-trans-cyclohexane dicarboxylic acid | 4 parts. |

6. Embodiment 6

This embodiment is almost the same as Embodiment 4 except that the composition of the mixture of the cis- and trans-alicyclic dicarboxylic acid compounds (10 parts) of the recording layer is composed as follows:

| | |
|---|---|
| 1,4-cis-cyclohexane dicarboxylic acid and | 5 parts; |
| 1,4-trans-cyclohexane dicarboxylic acid | 5 parts. |

7. Embodiment 7

This embodiment is almost the same as Embodiment 4 except that the composition of the mixture of the cis- and trans-alicyclic dicarboxylic acid compounds (10 parts) of the recording layer is composed as follows:

| | |
|---|---|
| 1,4-cis-cyclohexane dicarboxylic acid and | 4 parts; |
| 1,4-trans-cyclohexane dicarboxylic acid | 6 parts. |

8. Embodiment 8

This embodiment is almost the same as Embodiment 4 except that the composition of the mixture of the cis- and trans-alicyclic dicarboxylic acid compounds (10 parts) of the recording layer is composed as follows:

| | |
|---|---|
| 1,4-cis-cyclohexane dicarboxylic acid and | 2 parts; |
| 1,4-trans-cyclohexane dicarboxylic acid | 8 parts. |

9. Embodiment 9

This embodiment is almost the same as Embodiment 1 except that components (to be described below) of the recording layer 5 are coated on the adhesive layer 4 and then such a coat formed on the adhesive layer 4 is dried and thermally set at 100° C. for 5 minutes to form the recording layer 5, the thermally-set thickness of which is 9 μm.

Incidentally, the composition of the recording layer 5 is as follows:

| | |
|---|---|
| Behenic acid | (7 parts) |
| Eicosane diacid | (1 part) |
| 1,4-cis-cyclohexane dicarboxylic acid | (0.7 parts) |
| 1,4-trans-cyclohexane dicarboxylic acid | (0.3 parts) |

A total of the numbers of parts respectively corresponding to these components: 100 parts.

Further, the numbers of parts respectively corresponding to these components are determined by performing proportional allotment by using the total of the numbers of parts, namely, 100 parts and the ratios of the numbers respectively described in parentheses to 9 parts.

| | |
|---|---|
| Vinyl chloride-vinyl acetate-vinyl alcohol copolymer ("S-lec A" of SEKISUI CHEMICAL Co., Ltd.) | 300 parts |
| Isocyanate (a hardening agent "DURANATE 24A-100" of ASAHI CHEMICAL INDUSTRY Co., Ltd.) | 30 parts |
| Triethylenediamine (a hardening accelerator) | 3 parts |
| Toluene | 300 parts |
| Tetrahydrofuran | 1200 parts. |

10. Embodiments 10 to 14

Each of Embodiments 10 to 14 is almost the same as Embodiment 9 except that the mixing rates of the behenic acid, eicosane diacid and alicyclic dicarboxylic acid compound (incidentally, the ratio of the amount of the 1,4-cis-cyclohexane dicarboxylic acid to that of the 1,4-trans-cyclohexane dicarboxylic acid is 7:3) of the recording layer of each of Embodiments 10 to 14 is as shown in FIG. 3.

11. Comparative Example 1

This comparative example is a conventional thermosensitive recording medium formed by performing the following process.

First, components (to be described below) of the recording layer are coated on a polyester film having a thickness of 50 μm, on which aluminum is evaporated, by using a wire bar. Then, such a polyester film is heated and dried to form the recording layer, the thickness of which is about 15 μm. Subsequently, components of an intermediate layer (to be described below) are coated on the recording layer by the wire bar. Further, such a coat formed on the surface of the recording layer is heated and dried to make the intermediate layer, the thickness of which is about 1 μm.

Next, a solution of butyl acetate, which is urethane acrylic ultraviolet-curing resin, is coated on this intermediate layer by using the wire bar. Then, a protective layer having a thickness of about 2 μm is formed by heating and drying such a coat formed on the surface of the intermediate layer and irradiating ultraviolet rays onto such a coat from what is called an ultraviolet lamp of 80 W/cm for 5 seconds. Thus this comparative example of the conventional thermosensitive recording medium is completed.

Incidentally, the composition of the recording layer is as follows:

| | |
|---|---|
| Behenic acid | 95 parts |
| Eicosane diacid | 5 parts |
| (Aliphatic saturated dicarboxylic acid) | |
| Vinyl chloride-vinyl acetate copolymer | 250 parts |
| Di(2-ethylhexyl) phthalate | 30 parts |
| Tetrahydrofuran | 2000 parts. |

Further, the composition of the intermediate layer is as follows:

| | |
|---|---|
| Polyamide resin | 10 parts |
| Methyl alcohol | 90 parts. |

12. Comparative Example 2

This comparative example of the conventional thermosensitive recording medium is almost the same as Comparative Example 1 except that the ratio of the amount of the behenic acid to that of the eicosane diacid (the aliphatic saturated dicarboxylic acid) is as follows:

| | |
|---|---|
| Behenic acid | 80 parts |
| Eicosane diacid | 20 parts. |
| (Aliphatic saturated dicarboxylic acid) | |

13. Comparative Example 3

This comparative example of the conventional thermosensitive recording medium is almost the same as Comparative Example 1 except that the ratio of the amount of the behenic acid to that of the eicosane diacid (the aliphatic saturated dicarboxylic acid) is as follows:

| | |
|---|---|
| Behenic acid | 50 parts |
| Eicosane diacid | 50 parts. |
| (Aliphatic saturated dicarboxylic acid) | |

14. Comparative Example 4

This comparative example of the conventional thermosensitive recording medium is almost the same as Comparative Example 3 except that the composition of the recording layer is as follows:

| | |
|---|---|
| Behenic acid | 50 parts |
| Eicosane diacid | 50 parts |
| (Aliphatic saturated dicarboxylic acid) | |
| Vinyl chloride-vinyl acetate-vinyl alcohol copolymer ("S-lec A" of SEKISUI CHEMICAL Co., Ltd.) | 300 parts |
| Isocyanate (a hardening agent "DURANATE 24A-100" of ASAHI CHEMICAL INDUSTRY Co., Ltd.) | 30 parts |
| Triethylenediamine (a hardening accelerator) | 3 parts |
| Toluene | 300 parts |
| Tetrahydrofuran | 1200 parts. |

15. Comparative Example 5

This comparative example of the conventional thermosensitive recording medium is made by coating the top surface of a polyester film having a thickness of 100 μm with the following components of the recording layer and heating and drying such a coat to form the recording layer, the thickness of which is 15 μm. Namely, the composition of the recording layer is as follows:

| | |
|---|---|
| Behenic acid | 95 parts |
| $(CH_2)_{13}(COOH)_2$ | 5 parts |
| (Aliphatic saturated dicarboxylic acid) | |
| Vinyl chloride-vinyl acetate copolymer | 250 parts |
| Di(2-ethylhexyl) phthalate | 30 parts |
| Tetrahydrofuran | 2000 parts. |

16. Comparative Example 6

This comparative example of the conventional thermosensitive recording medium is almost the same as Comparative Example 5 except that the ratio of the amount of behenic acid to that of $(CH_2)_{13}(COOH)_2$ is as follows:

| | |
|---|---|
| Behenic acid | 80 parts |
| $(CH_2)_{13}(COOH)_2$ | 20 parts. |
| (Aliphatic saturated dicarboxylic acid) | |

17. "Comparative Experiments"

(1) Transparency Temperature Range

Next, the following "comparative experiment" was made for the purpose of making a comparison among the transparency temperature ranges of Embodiments 1 to 14 (hereunder sometimes referred to as Thermosensitive Recording Media 1 to 14) of the present invention and those of Comparative Examples 1 to 6 (hereunder sometimes referred to as Conventional Thermosensitive Recording Media 1 to 6).

Incidentally, the recording layers of the thus obtained Embodiments 1 to 14 of the present invention and those of Comparative Examples 1 to 6 were in an opaque state (namely, a milky white state).

First, each of the obtained thermosensitive recording media was heated from 65° C. to a predetermined degrees centigrade stepwise with a temperature interval of 1 degree of the centigrade scale and thereafter was cooled to room temperature. Then, reflection density (or optical density) of each of the thermosensitive recording media was measured by using what is called an optical reflection densitometer (namely, a MACBETH densitometer RD514).

Incidentally, in case of each of all Embodiments and Comparative Examples 1 to 4 (namely, the thermosensitive recording media), the reflection density was measured by utilizing light reflected by the light reflecting metal layer thereof containing aluminum. Further, in case of each of Comparative Examples 5 and 6, the reflection density was measured by utilizing light reflected by the corresponding conventional thermosensitive recording medium put on a piece of black drawing paper.

Furthermore, the temperatures, at which the measured reflection density exceeded 1.0, were recorded as the transparency temperatures (namely, the temperatures of the transparency temperature range). Thus, the transparency temperature range and the width thereof (hereunder referred to as the transparency temperature width) were determined in each case of Embodiments 1 to 14 and Comparative Examples 1 to 6. Results of the determination are shown in FIG. 4.

(2) Maximum Transparency and Maximum Opacity

Further, the maximum transparency and the maximum opacity of each of all Embodiments and Comparative Examples 1 to 3 (namely, all Thermosensitive Recording Media and Conventional Thermosensitive Recording Media 1 to 3) were measured to determine the contrast between an object image portion and a ground image portion in each case thereof and compare the determined contrasts with one another.

Incidentally, "CARD READER/WRITER KU-400" of KYUSHU MATSUSHITA ELECTRIC Co., Ltd is used as an evaluation system. Further, the measurement was effected under the following printing and erasing conditions. Namely, Printing conditions: 0.5 milli-joule (mJ)/dot (correspondingly to a whitely opaque condition); and Erasing conditions: 0.2 milli-joule (mJ)/dot (correspondingly to a transparent condition). Results of this measurement are also shown in FIG. 4.

Figure 2:
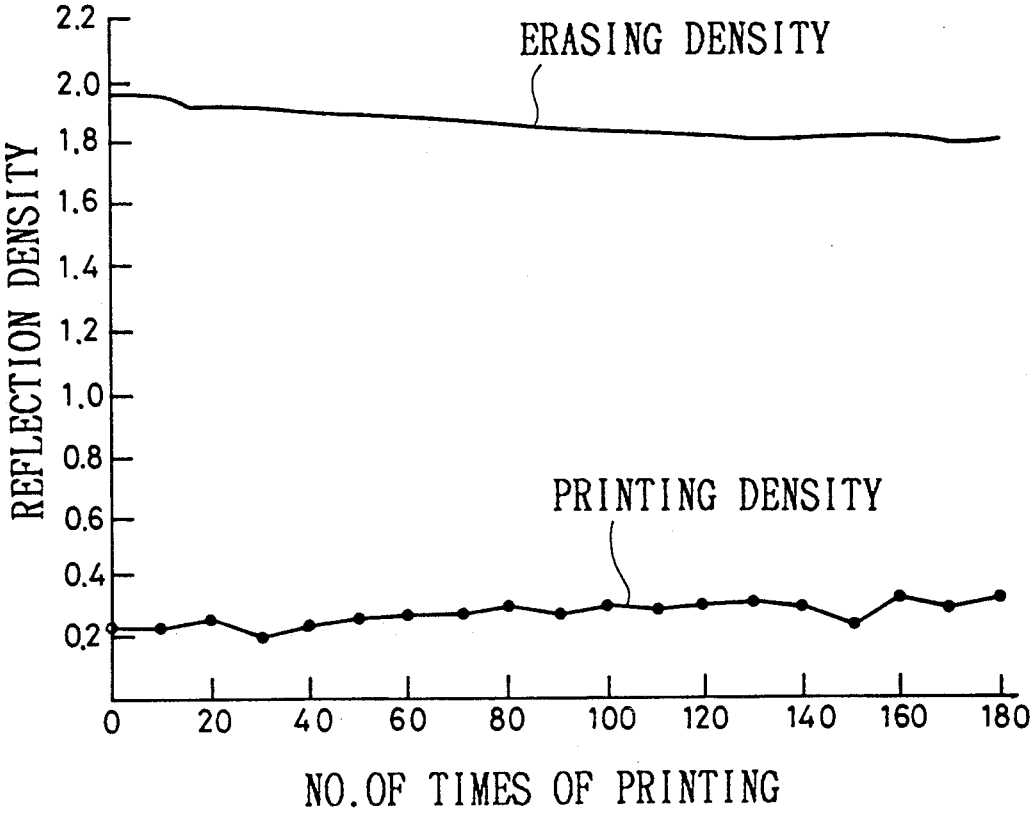
FIG. 2 is a graph for showing the relation among the number of times of printing operations performed on and the printing densities and the erasing densities employed for Embodiment 14 (to be described later) of the thermosensitive recording medium of FIG. 1.

(3) Test on Durability of Recording Layer against Iterative Rewriting Operations Further, a test was performed on the durability of the recording layer of Embodiment 14 (namely, Thermosensitive Recording Medium 14) against iterative rewriting operations. Incidentally, the above described evaluation system is used for this test. Moreover, every ten times of iterating rewriting operations under the same printing and erasing conditions, the printing density (namely, the opacity) and the erasing density (namely, the transparency) were measured by the MACBETH densitometer RD514. Results of the test are shown in FIG. 2.

18. Evaluation (1) Transparency Temperature Range (a) As is apparent from the comparison of the transparency temperature widths of Embodiment 3 and Comparative Example 1 (namely, Thermosensitive Recording Medium 3 and Conventional Thermosensitive Recording Medium 1), both of which employ thermoplastic resins as matrix materials, (namely, 64 degrees and 19 degrees of the centigrade scale (see FIG. 4)) with those of Embodiment 4 and Comparative Example 2 (namely, Thermosensitive Recording Medium 4 and Conventional Thermosensitive Recording Medium 2), both of which employ thermosetting resins as matrix materials, (namely, 35 degrees and 8 degrees of the centigrade scale (see FIG. 4)), the transparency temperature width of the thermosensitive recording medium in case of employing thermosetting resins as matrix materials becomes smaller than that of the thermosensitive recording medium in case of employing thermoplastic resins as matrix materials. Incidentally, in cases of Embodiments 4 to 14, each of which contains alicyclic dicarboxylic acid compounds in the organic low-molecular-weight material of the recording layer, the transparency temperature widths have large values of 35 to 77 degrees of the centigrade scale in spite of the fact that these embodiments employ thermosetting resins as matrix resins. Therefore, Embodiments 4 to 14 maintain characteristics suitable for a recording medium.

(b) Next, as is clearly confirmed from the comparison of the transparency temperature range of each Embodiment (namely, each Thermosensitive Recording Medium), in which an alicyclic dicarboxylic acid compound is added to the organic low-molecular-weight material of the recording layer, with that of each Comparative Example (namely, each Conventional Thermosensitive Recording Medium), in which an aliphatic dicarboxylic acid compound is added to the organic low-molecular-weight material, the transparency temperature range of the thermosensitive recording medium can be considerably enlarged by employing an alicyclic carboxylic acid compound as an additive for enlarging the transparency temperature width instead of an aliphatic dicarboxylic acid compound conventionally used as an additive. Enlargement of the transparency temperature width makes it easier to set the heating temperature of the heating means such as a thermal head within the transparency temperature range at a high speed. Thus, it is confirmed that a transparent object image portion can be relatively easily formed using a white ground image portion (namely, a portion but into a whitely opaque state) as a background.

(c) Moreover, as is clearly confirmed from the comparison of the transparency temperature widths of Embodiments 1 and 2, in which only cis-alicyclic dicarboxylic acid compound is added to the organic low-molecular-weight material of the recording layer (incidentally, thermoplastic resins are employed as matrix materials), with that of Embodiment 3 (namely, Thermosensitive Recording Medium 3), in which a mixture of cis- and trans-alicyclic dicarboxylic acid compounds is added to the organic low-molecular-weight material (incidentally, thermoplastic resins are employed as matrix materials similarly as in cases of Embodiments 1 and 2 (namely, Thermosensitive Recording Media 1 and 2)), the transparency temperature width of the thermosensitive recording medium can be further enlarged by adding such a mixture to the organic low-molecular-weight material. Additionally, it can be also confirmed from data on the transparency temperature widths of Embodiments 4 to 14 (namely, Thermosensitive Recording Media 4 to 14) of FIG. 4 that these embodiments maintain characteristic suitable for a recording medium by adding to such a mixture to the organic low-molecular-weight material in spite of the fact that these embodiments employ thermosetting resins as matrix resins.

Especially, note that the transparency temperature width of Embodiment 6 is 77 degrees of the centigrade scale, which is larger than that of any other embodiment (see FIG. 4). Thus it can be confirmed that when the ratio of the amount of the cis-alicyclic dicarboxylic acid compound of such a mixture to that of the trans-alicyclic dicarboxylic acid compound thereof is 1:1, the addition of such a mixture to the organic low-molecular-weight material has a large effect on the transparency temperature width of the thermosensitive recording medium.

(2) Maximum Transparency and Maximum Opacity (a) Next, as is apparent from the comparison of the maximum opacity (namely, 0.12 to 0.23) of each Embodiment (namely, each Thermosensitive Recording Medium) of FIG. 4 with that (namely, 0.34 to 0.40) of each of the Comparative Examples 2 and 3 (namely, Conventional Thermosensitive Recording Media 2 and 3), reduction in opacity of each of Conventional Thermosensitive Recording Media 2 and 3 is large. This is due to the fact that the ratio of the amount of an aliphatic dicarboxylic acid compound to that of behenic acid, which is the organic low-molecular-weight material, in case of each of Conventional Thermosensitive Recording Media 2 and 3 is large in comparison with such a ratio in case of each Embodiment, in which an alicyclic dicarboxylic acid compound is added to the organic low-molecular-weight material and that thus the mixing ratio of the amount of the organic low-molecular-weight material to the total amount of the components of the recording layer decreases.

(b) Further, as is apparent from the comparison of the maximum transparencies (namely, 1.75 to 1.97) of Embodiments 9 to 14 (namely, Thermosensitive Recording media 9 to 14), in which an alicyclic dicarboxylic acid compound and an aliphatic dicarboxylic acid compound are added to the organic low-molecular-weight material of the recording layer, with those of the other Embodiments (namely, the other Thermosensitive Recording Media), it is confirmed that the transparency of the thermosensistive recording medium can be improved by adding an aliphatic dicarboxylic acid compound, as well as an alicyclic dicarboxylic acid compound, to the organic low-molecular-weight material.

Thus, the reduction in opacity can be prevented and the transparency can be improved. Consequently, it is also confirmed that in each case of Embodiments (namely, Thermosensitive Recording Media), high contrast between an object image portion and a ground image portion can be obtained.

(3) Evaluation of Durability of Recording Layer against Iterative Rewriting Operations As is seen from FIG. 2, the change in the printing density (namely, the opacity) and that in the erasing density (namely, the transparency) are little even in case that the printing operations are iterated a large number of times. Moreover, the difference between the erasing density (namely, the transparency of an image portion, at which an object such as a character had been printed, at the time of erasing the printed object) and the transparency of the ground image portion is little and therefore the initial transparent state is recovered or maintained in the recording layer. Thus it is confirmed that the durability of the recording layer can be improved.

19. Effects of Embodiments of The Invention

As described above, in case of the rewritable thermosensitive recording medium of the present invention, by adding the alicyclic dicarboxylic acid compound is added to the organic low-molecular-weight material, the eutectic point of the organic low-molecular-weight material and the alicyclic dicarboxylic acid compound becomes higher than the melting point of the organic low-molecular-weight material. Moreover, the difference between the eutectic point of the organic low-molecular-weight material and the alicyclic dicarboxylic acid compound and the melting point of the organic low-molecular-weight material is much larger than those obtained in cases of the conventional recording materials. Consequently, the transparency temperature range can be considerably enlarged.

Further, the transparency temperature range can be further enlarged by employing a mixture of a cis-alicyclic-dicarboxylic acid compound and a trans-alicyclic-dicarboxylic acid compound as the alicyclic dicarboxylic acid compound to be added to the organic low-molecular-weight material.

On the other hand, even in case where the addition ratio of the alicyclic dicarboxylic acid compound is small, the transparency temperature range can be sufficiently enlarged in comparison with those of the conventional recording media using the aliphatic dicarboxylic acid compound. Thus, when the addition ratio of the alicyclic dicarboxylic acid compound is small, the reduction in opacity of the recording layer can be prevented.

Furthermore, the reduction in transparency of the recording layer can be prevented by adding the aliphatic dicarboxylic acid compound, as well as the alicyclic dicarboxylic acid compound, to the organic low-molecular-weight material.

Consequently, it becomes easy to set the heating temperature of the heating means such as a thermal head within the transparency temperature range at a high speed. Thus the formation of a transparent object image with a white ground image (namely, an image portion put in a milky white state) for a background, as well as that of a white object image with a transparent ground image portion (namely, an image portion put in a transparent state), can be easily achieved. As a consequence, the range of application of the recording medium of this kind can be widened. Moreover, in case of the recording medium of the present invention, the reduction in contrast between an object image portion and a ground image portion is hard to occur. Thus, recording picture quality can be improved.

Additionally, the reduction in opacity of the recording layer due to heat deterioration thereof can be prevented by employing the thermosetting resin containing a hydroxyl denatured vinyl chloride-vinyl acetate copolymer and an isocyanate compound as the matrix material. Thus the rewritable thermosensitive recording medium of the present invention has an advantage in that the durability of the surface of the recording layer against iterative rewriting operations can be improved.

While preferred embodiments of the present invention have been described above, it is to be understood that the present invention is not limited thereto and that other modifications will be apparent to those skilled in the art without departing from the spirit of the invention.

The scope of the present invention, therefore, is to be determined solely by the appended claims.

What is claimed is:

1. A rewritable thermosensitive recording medium comprising a recording layer, the transparency of which reversibly changes depending on the temperature thereof, and a support for the recording layer, said recording layer comprising organic low-molecular-weight materials in 2–6 parts by weight of a matrix per part of the organic low-molecular-weight materials, said low-molecular-weight materials comprising 2–30% by weight of at least one alicyclic dicarboxylic acid.

2. The rewritable thermosensitive recording medium according to claim 1, wherein the at least one alicyclic dicarboxylic acid in the recording layer is selected from the group consisting of 1,1-cyclopropane dicarboxylic acid, 1,2-cis-cyclopropane dicarboxylic acid, 1,2-trans-cyclopropane dicarboxylic acid, 1,1-cyclobutane dicarboxylic acid, 1,2-cis-cyclobutane dicarboxylic acid, 1,2-trans-cyclobutane dicarboxylic acid, 1,3-cis-cyclobutane dicarboxylic acid, 1,3-trans-cyclobutane dicarboxylic acid, 1,1-cyclopentane dicarboxylic acid, 1,2-trans-cyclopentane dicarboxylic acid, 1,2-cis-cyclopentane dicarboxylic acid, 1,3-cis-cyclopentane dicarboxlic acid, 1,3-trans-cyclopentane dicarboxylic acid, 1,2-cis-cyclohexane dicarboxylic acid, 1,2-trans-cyclohexane dicarboxylic acid, 1,3-cis-cyclohexane dicarboxylic acid, 1,3-trans-cyclohexane dicarboxylic acid, 1,4-cis-cyclohexane dicarboxylic acid and 1,4-trans-cyclohexane dicarboxylic acid.

3. The rewritable thermosensitive recording medium according to claim 2, wherein the at least one alicyclic dicarboxylic acid in the recording layer is a mixture containing a cis-alicyclic dicarboxylic acid and a trans-alicyclic dicarboxylic acid.

4. The rewritable thermosensitive recording medium according to claim 3, wherein the mixture contains equal amounts of the cis- and the trans-alicyclic dicarboxylic acids.

5. The rewritable thermosensitive recording medium according to claim 1, wherein the matrix additionally contains an aliphatic dicarboxylic acid.

6. The rewritable thermosensitive recording medium according to claim 1, wherein the matrix is a thermosetting resin containing a hydroxyl denatured vinyl chloride-vinyl acetate copolymer and an isocyanate compound.

* * * * *